US010835795B1

(12) United States Patent
Wilson

(10) Patent No.: US 10,835,795 B1
(45) Date of Patent: Nov. 17, 2020

(54) SPORTS BLOCKING PAD APPARATUS

(71) Applicant: Ricardo Wilson, Reynoldsburg, OH (US)

(72) Inventor: Ricardo Wilson, Reynoldsburg, OH (US)

( * ) Notice: Subject to any disclaimer, the term of this patent is extended or adjusted under 35 U.S.C. 154(b) by 7 days.

(21) Appl. No.: 16/509,101

(22) Filed: Jul. 11, 2019

(51) Int. Cl.
*A63B 69/00* (2006.01)
*F41H 5/08* (2006.01)
*A63B 71/08* (2006.01)

(52) U.S. Cl.
CPC ..... *A63B 69/00* (2013.01); *A63B 69/004* (2013.01); *A63B 71/08* (2013.01); *F41H 5/08* (2013.01); *A63B 2244/10* (2013.01)

(58) Field of Classification Search
CPC ..... A63B 69/00; A63B 69/002; A63B 69/004; A63B 69/26; A63B 69/325; A63B 69/34; A63B 69/345; A63B 71/08; A63B 2244/10; A63B 21/00047; A63B 21/4001; A63B 21/4007; A63B 21/4017; A63B 21/4019; A63B 21/4021; A63B 2022/0092; A63B 2022/0094; A63B 2071/1208; F41H 5/08
See application file for complete search history.

(56) References Cited

U.S. PATENT DOCUMENTS

| | | | | | |
|---|---|---|---|---|---|
| 2,526,217 | A * | 10/1950 | Gilman | A63B 69/345 | 473/444 |
| D171,590 | S | 3/1957 | Gilman | | |
| 3,396,969 | A | 8/1968 | Rosenfeld | | |
| 4,546,966 | A | 10/1985 | Segura | | |
| 4,667,954 | A * | 5/1987 | McCorkle | A63B 69/26 | 473/444 |
| 5,329,636 | A | 7/1994 | Siddle | | |
| 5,454,560 | A * | 10/1995 | Pan | A63B 69/0013 | 229/125.39 |
| 5,501,649 | A | 3/1996 | Queppet | | |
| 7,056,238 | B1 | 6/2006 | Brown | | |
| D669,954 | S | 10/2012 | Rovere | | |
| 8,287,437 | B1 * | 10/2012 | Rovere | A63B 71/08 | 482/83 |
| 8,708,868 | B2 | 4/2014 | Partlo | | |
| D789,612 | S | 6/2017 | Gaynor | | |
| 10,145,656 | B2 * | 12/2018 | Gaynor | F41H 5/08 | |
| 10,245,486 | B2 * | 4/2019 | Burgess | A63B 55/408 | |
| 2017/0001091 | A1 * | 1/2017 | Holmes | A63B 69/26 | |

* cited by examiner

*Primary Examiner* — Megan Anderson

(57) ABSTRACT

A sports blocking pad apparatus for improved grip and protection for contact sports training includes a pad body defining a pad cavity. A pad filling is coupled within the pad cavity and is shock absorbent. An X-strap comprises a first diagonal strap and a second diagonal strap coupled to a back side of the pad body. The second diagonal strap is coupled to the first diagonal strap at an intersection portion of the first diagonal strap and the second diagonal strap. A plurality of rivets is coupled to the X-strap through the intersection portion. A plurality of handle straps is coupled to the pad body. Each of the plurality of handle straps is coupled to the back side, vertically oriented, and configured to receive a user's hand.

8 Claims, 5 Drawing Sheets

SPORTS BLOCKING PAD APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sports pads and more particularly pertains to a new sports pad for improved grip and protection for contact sports training.

BRIEF SUMMARY OF THE INVENTION

An embodiment of the disclosure meets the needs presented above by generally comprising a pad body having a front side, a back side, a left side, a right side, a top side, and a bottom side defining a pad cavity. A pad filling is coupled within the pad cavity and is shock absorbent. An X-strap is coupled to the pad body and comprises a first diagonal strap and a second diagonal strap coupled to the pad body. The first diagonal strap is coupled to a top left corner and a bottom right corner of the back side of the pad body and the second diagonal strap is coupled to a bottom left corner and a top right corner of the back side of the pad body. The second diagonal strap is coupled to the first diagonal strap at an intersection portion of the first diagonal strap and the second diagonal strap. A plurality of rivets is coupled to the X-strap through the intersection portion. A plurality of handle straps is coupled to the pad body. Each of the plurality of handle straps is coupled to the back side, vertically oriented, and configured to receive a user's hand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
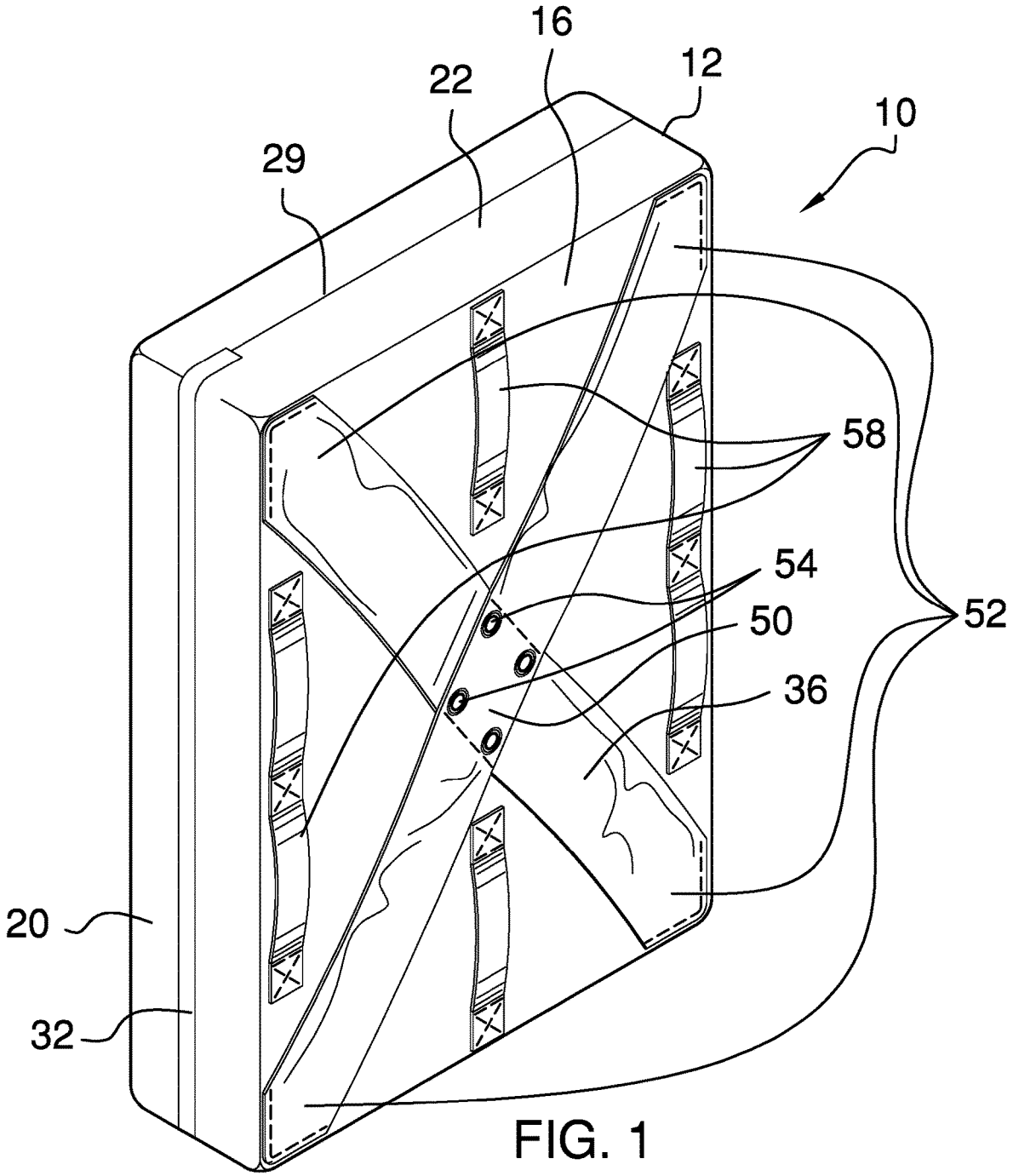
FIG. 1 is an isometric view of a sports blocking pad apparatus according to an embodiment of the disclosure.
Figure 2:
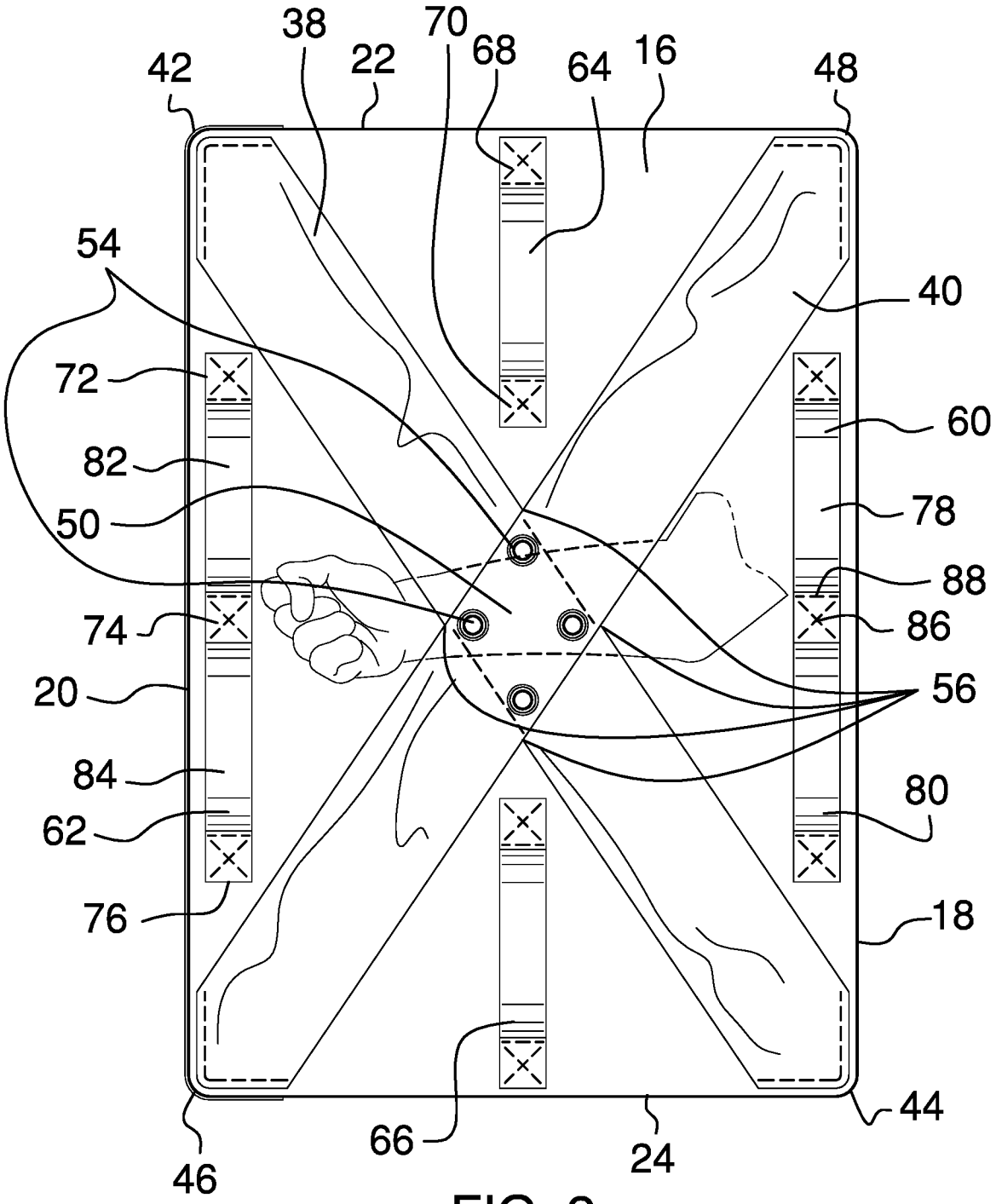
FIG. 2 is a rear elevation view of an embodiment of the disclosure.
Figure 3:
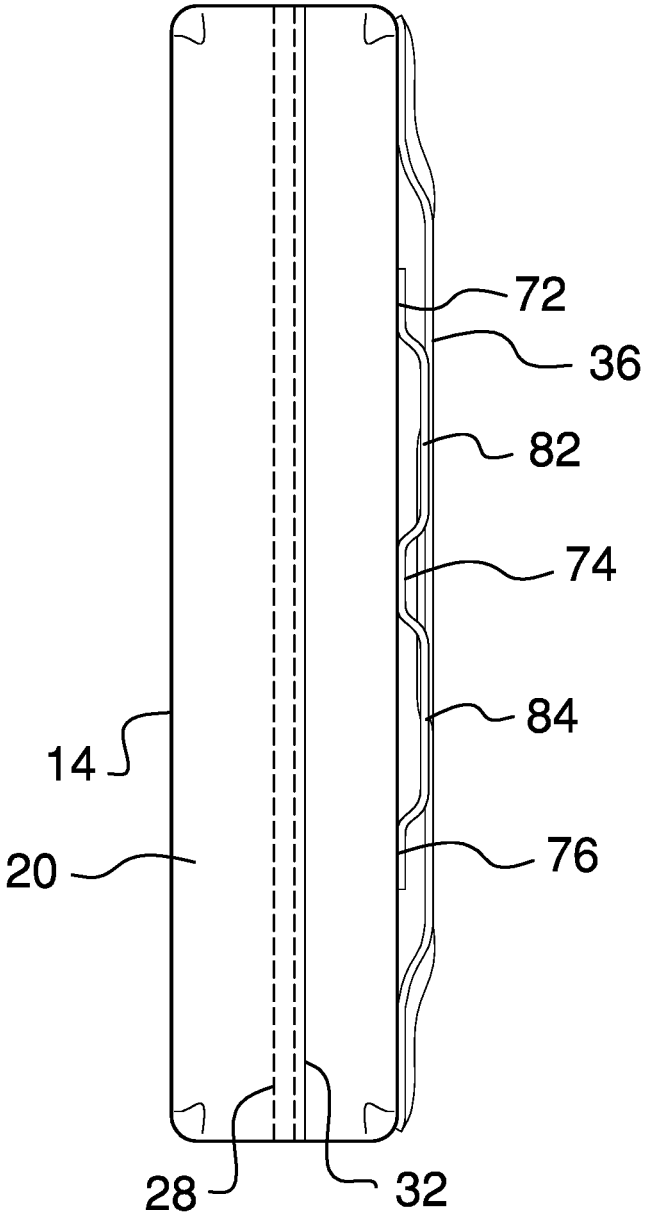
FIG. 3 is a side elevation view of an embodiment of the disclosure.
Figure 4:
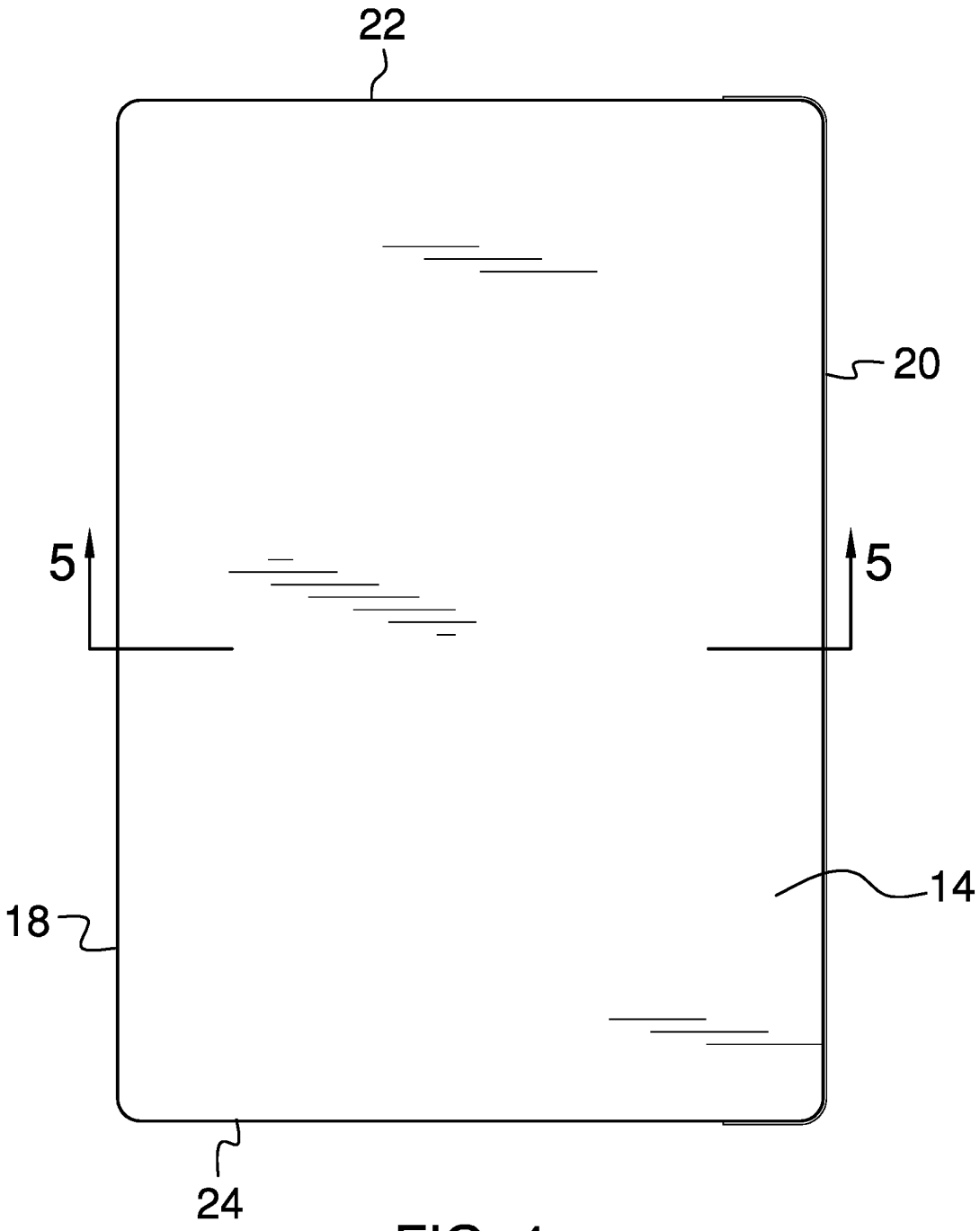
FIG. 4 is a front elevation view of an embodiment of the disclosure.
Figure 5:
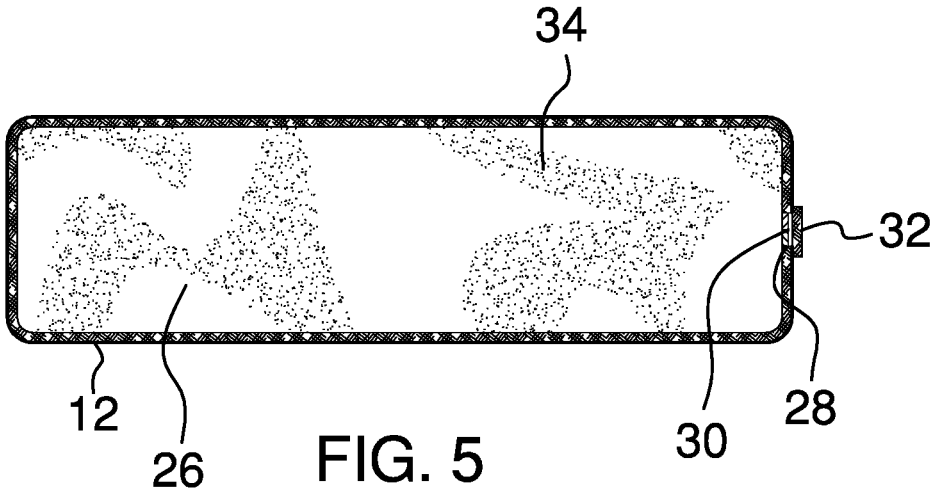
FIG. 5 is a cross-sectional view along line 5-5 of FIG. 4 of an embodiment of the disclosure.

With reference now to the drawings, and in particular to FIGS. 1 through 5 thereof, a new sports pad embodying the principles and concepts of an embodiment of the disclosure and generally designated by the reference numeral 10 will be described.

As best illustrated in FIGS. 1 through 5, the sports blocking pad apparatus 10 generally comprises a pad body 12 having a front side 14, a back side 16, a left side 18, a right side 20, a top side 22, and a bottom side 24 defining a pad cavity 26. The pad body 12 has a zipper opening 28 extending along a midline 29 of the top side 22, the right side 20, and the bottom side 24 through to the pad cavity 26. A zipper 30 is coupled to the zipper opening 28 to selectively seal and alternatively expose the pad cavity 26. A zipper cover 32 is coupled to the pad body 12. The zipper cover 32 foldably covers the zipper 30 to prevent accidental contact with the zipper 30 when striking the apparatus 10. A pad filling 34 is coupled within the pad cavity 26 and is removable through the zipper opening 28 to be repaired or replaced. The pad filling 34 is shock absorbent and may be a foam material.

An X-strap 36 is coupled to the pad body 12 and comprises a first diagonal strap 38 and a second diagonal strap 40 coupled to the back side 16. The first diagonal strap 38 is coupled to a top left corner 42 and a bottom right corner 44 of the back side 16 of the pad body and the second diagonal strap 40 is coupled to a bottom left corner 46 and a top right corner 48 of the back side 16 of the pad body. The second diagonal strap 40 is coupled to the first diagonal strap 38 at an intersection portion 50 of the first diagonal strap 38 and the second diagonal strap 40. The first diagonal strap 38 and the second diagonal strap 40 each have a pair of squared outer ends 52 conforming to a perimeter of the back side 16 of the pad body. A plurality of rivets 54 is coupled to the X-strap 36 through the intersection portion 50. The plurality of rivets 54 may be four rivets 54 coupled adjacent a set of four overlap corners 56 of the intersection portion.

A plurality of handle straps 58 is coupled to the pad body 12. Each of the plurality of handle straps 58 is coupled to the back side 16, vertically oriented and configured to receive a user's hand. The plurality of handle straps 58 comprises a left handle strap 60 adjacent the left side 18, a right handle strap 62 adjacent the right side 20, a top handle 64 strap adjacent the top side 22, and a bottom handle strap 66 adjacent the bottom side 24. Each of the top handle strap 64 and the bottom handle strap 66 have an upper stitched area 68 and a lower stitched area 70 coupled to the back side 16 of the pad body. Each of the left handle strap 60 and the right handle strap 62 have a top stitched area 72, a middle stitched area 74, and a bottom stitched area 76 coupled to the back side 16 of the pad body to effectively create an upper left handle strap 78 and a lower left handle strap 80 of the left handle strap 60 and an upper right handle strap 82 and a lower right handle strap 84 of the right handle strap 62. The upper stitched area 68, the lower stitched area 70, the top stitched area 72, the middle stitched area 74, and the bottom stitched area 76 may each be square with an X-shaped stitch 86 and an inner edge stitch 88.

In use, the user places his arm through the X-strap 36 and secures one of the plurality of handle straps 58 with his hand. The user then secures the apparatus 10 for his training partner to strike the front side 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sports blocking pad apparatus comprising:

a pad body, the pad body having a front side, a back side, a left side, a right side, a top side, and a bottom side defining a pad cavity;

a pad filling coupled to the pad body, the pad filling being coupled within the pad cavity, the pad filling being shock absorbent;

an X-strap coupled to the pad body, the X-strap comprising:

a first diagonal strap coupled to the pad body, the first diagonal strap being coupled to a top left corner and a bottom right corner of the back side of the pad body; and a second diagonal strap coupled to the pad body, the second diagonal strap being coupled to a bottom left corner and a top right corner of the back side of the pad body, the second diagonal strap being coupled to the first diagonal strap at an intersection portion of the first diagonal strap and the second diagonal strap;

a plurality of rivets coupled to the X-strap, the plurality of rivets being coupled through the intersection portion; and a plurality of handle straps coupled to the pad body, each of the plurality of handle straps being coupled to the back side, vertically oriented, and configured to receive a user's hand.

2. The sports blocking pad apparatus of claim 1 further comprising the pad body having a zipper opening extending along a midline of the top side, the right side, and the bottom side through to the pad cavity, a zipper being coupled to the zipper opening to selectively seal and alternatively expose the pad cavity.

3. The sports blocking pad apparatus of claim 2 further comprising a zipper cover coupled to the pad body, the zipper cover foldably covering the zipper.

4. The sports blocking pad apparatus of claim 1 further comprising the plurality of handle straps comprising a left handle strap adjacent the left side, a right handle strap adjacent the right side, a top handle strap adjacent the top side, and a bottom handle strap adjacent the bottom side.

5. The sports blocking pad apparatus of claim 4 further comprising each of the top handle strap and the bottom handle strap having an upper stitched area and a lower stitched area coupled to the back side of the pad body, the left handle strap and the right handle strap having a top stitched area, a middle stitched area, and a bottom stitched area coupled to the back side of the pad body to effectively create an upper left handle strap and a lower left handle strap of the left handle strap and an upper right handle strap and a lower right handle strap of the right handle strap.

6. The sports blocking pad apparatus of claim 1 further comprising the first diagonal strap and the second diagonal strap each having a pair of squared outer ends conforming to a perimeter of the back side of the pad body.

7. The sports blocking pad apparatus of claim 1 further comprising the plurality of rivets being four rivets coupled adjacent a set of four overlap corners of the intersection portion.

8. A sports blocking pad apparatus comprising:

a pad body, the pad body having a front side, a back side, a left side, a right side, a top side, and a bottom side defining a pad cavity, the pad body having a zipper opening extending along a midline of the top side, the right side, and the bottom side through to the pad cavity;

a zipper coupled to the pad body, the zipper being coupled to the zipper opening to selectively seal and alternatively expose the pad cavity;

a zipper cover coupled to the pad body, the zipper cover foldably covering the zipper;

a pad filling coupled to the pad body, the pad filling being coupled within the pad cavity, the pad filling being shock absorbent;

an X-strap coupled to the pad body, the X-strap comprising:

a first diagonal strap coupled to the pad body, the first diagonal strap being coupled to a top left corner and a bottom right corner of the back side of the pad body; and a second diagonal strap coupled to the pad body, the second diagonal strap being coupled to a bottom left corner and a top right corner of the back side of the pad body, the second diagonal strap being coupled to the first diagonal strap at an intersection portion of the first diagonal strap and the second diagonal strap, the first diagonal strap and the second diagonal strap each having a pair of squared outer ends conforming to a perimeter of the back side of the pad body;

a plurality of rivets coupled to the X-strap, the plurality of rivets being coupled through the intersection portion, the plurality of rivets being four rivets coupled adjacent a set of four overlap corners of the intersection portion; and a plurality of handle straps coupled to the pad body, each of the plurality of handle straps being coupled to the back side, vertically oriented, and configured to receive a user's hand, the plurality of handle straps comprising a left handle strap adjacent the left side, a right handle strap adjacent the right side, a top handle strap adjacent the top side, and a bottom handle strap adjacent the bottom side, each of the top handle strap and the bottom handle strap having an upper stitched area and a lower stitched area coupled to the back side of the pad body, the left handle strap and the right handle strap having a top stitched area, a middle stitched area, and a bottom stitched area coupled to the back side of the pad body to effectively create an upper left handle strap and a lower left handle strap of the left handle strap and an upper right handle strap and a lower right handle strap of the right handle strap.

* * * * *